US010883691B2

(12) United States Patent
Huang et al.

(10) Patent No.: US 10,883,691 B2
(45) Date of Patent: Jan. 5, 2021

(54) ILLUMINATION STRUCTURE AND LIGHT DISTRIBUTING METHOD FOR THE ILLUMINATION STRUCTURE

(71) Applicant: ADI OPTICS, Taipei (TW)

(72) Inventors: Tzu-Tse Huang, Taipei (TW); Yi Chen, Taipei (TW); Chuan-Kao Wei, Taipei (TW); Chih-Wei Tseng, Taipei (TW); Yi-Ren Lin, Taipei (TW)

(73) Assignee: ADI OPTICS, Taipei (TW)

( * ) Notice: Subject to any disclaimer, the term of this patent is extended or adjusted under 35 U.S.C. 154(b) by 0 days.

(21) Appl. No.: 15/696,707

(22) Filed: Sep. 6, 2017

(65) Prior Publication Data

US 2018/0066821 A1 Mar. 8, 2018

(30) Foreign Application Priority Data

Sep. 7, 2016 (TW) ..... 105128890 A

(51) Int. Cl.
*F21S 41/36* (2018.01)
*F21V 29/70* (2015.01)
(Continued)

(52) U.S. Cl.
CPC ..... *F21S 41/36* (2018.01); *F21S 41/141* (2018.01); *F21S 41/148* (2018.01);
(Continued)

(58) Field of Classification Search
CPC ..... F21S 41/36; F21S 41/155; F21S 41/151; F21S 41/321; F21S 41/192; F21S 41/148; F21S 41/255; F21S 41/141
See application file for complete search history.

(56) References Cited

U.S. PATENT DOCUMENTS 7,993,043 B2 * 8/2011 Sazuka ..... B60Q 1/14 362/509
2005/0068787 A1 3/2005 Ishida
(Continued)

FOREIGN PATENT DOCUMENTS

CN 101082398 A 12/2007
CN 101463960 A 6/2009
(Continued)

OTHER PUBLICATIONS

Examiner Search Report Issued in Connection with Corresponding European Patent Application No. 17189708.5, dated Jan. 26, 2018.

*Primary Examiner* — Sharon E Payne
(74) *Attorney, Agent, or Firm* — Behmke Innovation Group LLC; James M. Behmke; James J. Wong

(57) ABSTRACT

The present disclosure provides an illumination structure and a light distributing method. The illumination structure includes a substrate, a first light emitting element, a second light emitting element, a reflection housing and a hooding board. The reflection housing has a first focal point and a second focal point. The first light emitting element is disposed on the substrate and located at the first focal point of the reflection housing. The second focal point is positioned within the hooding board. Therefore, a portion of light emitted by the first light emitting element will be reflected by the reflection housing and pass through a hollow portion of the hooding board to generate low beam light.

10 Claims, 7 Drawing Sheets

(51) Int. Cl.

| | |
|---|---|
| ***F21S 41/33*** | (2018.01) |
| ***F21S 41/255*** | (2018.01) |
| ***F21S 41/151*** | (2018.01) |
| ***F21S 41/43*** | (2018.01) |
| ***F21S 41/155*** | (2018.01) |
| ***F21S 41/19*** | (2018.01) |
| ***F21S 41/148*** | (2018.01) |
| ***F21S 41/663*** | (2018.01) |
| ***F21S 41/365*** | (2018.01) |
| ***F21V 29/77*** | (2015.01) |
| ***F21S 41/141*** | (2018.01) |
| ***F21S 41/29*** | (2018.01) |
| ***F21S 41/32*** | (2018.01) |
| ***F21S 45/47*** | (2018.01) |
| *F21Y 105/10* | (2016.01) |
| *F21W 102/13* | (2018.01) |
| *F21W 107/10* | (2018.01) |
| *F21Y 107/90* | (2016.01) |
| *F21Y 115/10* | (2016.01) |

(52) U.S. Cl.

CPC ..... *F21S 41/151* (2018.01); *F21S 41/155* (2018.01); *F21S 41/192* (2018.01); *F21S 41/255* (2018.01); *F21S 41/29* (2018.01); *F21S 41/321* (2018.01); *F21S 41/336* (2018.01); *F21S 41/365* (2018.01); *F21S 41/43* (2018.01); *F21S 41/663* (2018.01); *F21S 45/47* (2018.01); *F21V 29/777* (2015.01); *F21W 2102/13* (2018.01); *F21W 2107/10* (2018.01); *F21Y 2105/10* (2016.08); *F21Y 2107/90* (2016.08); *F21Y 2115/10* (2016.08)

(56) References Cited

U.S. PATENT DOCUMENTS

| | | | | |
|---|---|---|---|---|
| 2005/0259431 | A1* | 11/2005 | Iwasaki ..... | F21S 48/1159 362/514 |
| 2006/0171160 | A1 | 8/2006 | Meyrenaud et al. | |
| 2007/0086202 | A1 | 4/2007 | Tsukamoto et al. | |
| 2010/0067249 | A1* | 3/2010 | Suzuki ..... | B60Q 1/076 362/539 |
| 2011/0205748 | A1 | 8/2011 | Yatsuda | |
| 2013/0107564 | A1 | 5/2013 | Yatsuda | |
| 2015/0241012 | A1 | 8/2015 | Wang | |
| 2017/0267161 | A1* | 9/2017 | Letoumelin ..... | B60Q 1/06 |

FOREIGN PATENT DOCUMENTS

| | | | |
|---|---|---|---|
| DE | 202014103993 | U1 | 9/2014 |
| DE | 202015107084 | U1 | 1/2016 |
| EP | 2985515 | A1 | 2/2016 |
| JP | 2006134810 | A | 5/2006 |
| KR | 200449756 | Y1 | 8/2010 |
| KR | 20160065558 | A | 6/2016 |
| TW | M536321 | U | 2/2017 |

* cited by examiner

ILLUMINATION STRUCTURE AND LIGHT DISTRIBUTING METHOD FOR THE ILLUMINATION STRUCTURE

RELATED APPLICATION

This application claims the benefit of Taiwanese patent application No. 105128890, filed on Sep. 7, 2016, the entire content of which is incorporated herein.

BACKGROUND

1. Technical Field

The present disclosure relates to illumination structures and light distributing methods for the illumination structures, and, more particularly, to an illumination structure with improved light emitting efficiency and a light distributing method for the illumination structure.

2. Description of Related Art

Many vehicles (for example, cars, motorcycles, etc.) need to turn on car lamp to enhance the field of view in specific environments (for example, during the nighttime, tunnel, or poor visibility caused by the weather) in order to maintain vehicles' safeness. A car lamp can be switched to function as a low beam or a high beam.

In order to function as a low beam and a high beam, a car lamp made by the traditional halogen bulb has to include a large number of components, which are complicated to be assembled and are thus costly. When the halogen bulb is broken and the user wants to replace it with an LED light source, since a reflective lamp cup of the car lamp is not designed for the LED light source, a light pattern produced by the car lamp is not likely in compliance with laws and regulations.

Therefore, how to provide an illumination structure and a light distributing method to solve the above problem is one of the issues that needs to be solved currently.

SUMMARY

The present disclosure provides an illumination structure and a light distributing method to solve the above problems of the prior art. The illumination structure according to the present disclosure replaces halogen, tungsten-halogen or HID automotive headlamps, and produces a light pattern that is in compliance with regulations.

The present disclosure provides an illumination structure that can be disposed in a car lamp having a reflective lamp cup. The illumination structure includes: a substrate having opposing first and second faces; a reflection housing disposed on the first face and having a first focal point and a second focal point; a first light emitting element disposed on the first face of the substrate and received in the reflection housing in a manner that the light emitting element is located at the first focal point; a second light emitting element disposed on the second face of the substrate; and a hooding board having a hollow portion and coupled to the substrate in a manner that the hollow portion is away from the substrate, wherein a first portion of light emitted by the first light emitting element is reflected by the reflection housing and passes through the hollow portion of the hooding board.

The present disclosure also provides a light distributing method for an illumination structure that is applicable to a car lamp having a reflective lamp cup. The light distributing method includes: providing an illumination structure that has a substrate having opposing first and second faces, a reflection housing disposed on the first face and having a first focal point and a second focal point, a second light emitting element disposed on the second face of the substrate, a first light emitting element disposed on the first face of the substrate and received in the reflection housing in a manner that the first light emitting element is located at the first focal point, and a hooding board having a hollow portion and coupled to the substrate in a manner that the hollow portion is away from the substrate; emitting, by the first light emitting element, light, and reflecting, by the reflection housing, the light; and focusing a second portion of the light emitted by the first light emitting element and reflected by the reflection housing on the hooding board, allowing a first portion of the light to pass through the hollow portion.

According to the light distributing method for an illumination structure of the present disclosure, a first portion of the light emitted upwardly by the first light emitting element, which is located at the first focal point of the reflection housing, is reflected by the reflection housing and passes through the hollow portion of the hooding board to produce a light pattern that is in compliance with regulations. As the reflection housing receiving the first light emitting element is incorporated in the illumination structure according to the present disclosure and the second light emitting element is disposed in the same location as is a traditional halogen bulb, the illumination structure can be installed in a car lamp directly, where the traditional halogen bulb is disposed in the reflective lamp cup. Therefore, users can be switched to a LED light source from a traditional halogen bulb of a car lamp conveniently.

BRIEF DESCRIPTION OF DRAWINGS

The disclosure can be more fully understood by reading the following detailed description of the embodiments, with reference made to the accompanying drawings, wherein.

DETAILED DESCRIPTION OF THE DISCLOSURE

The following illustrative embodiments are provided to illustrate the disclosure of the present disclosure, these and other advantages and effects can be apparently understood by those in the art after reading the disclosure of this specification. The present disclosure can also be performed or applied by other different embodiments. The details of the specification may be on the basis of different points and applications, and numerous modifications and variations can be devised without departing from the spirit of the present disclosure.

Figure 1:
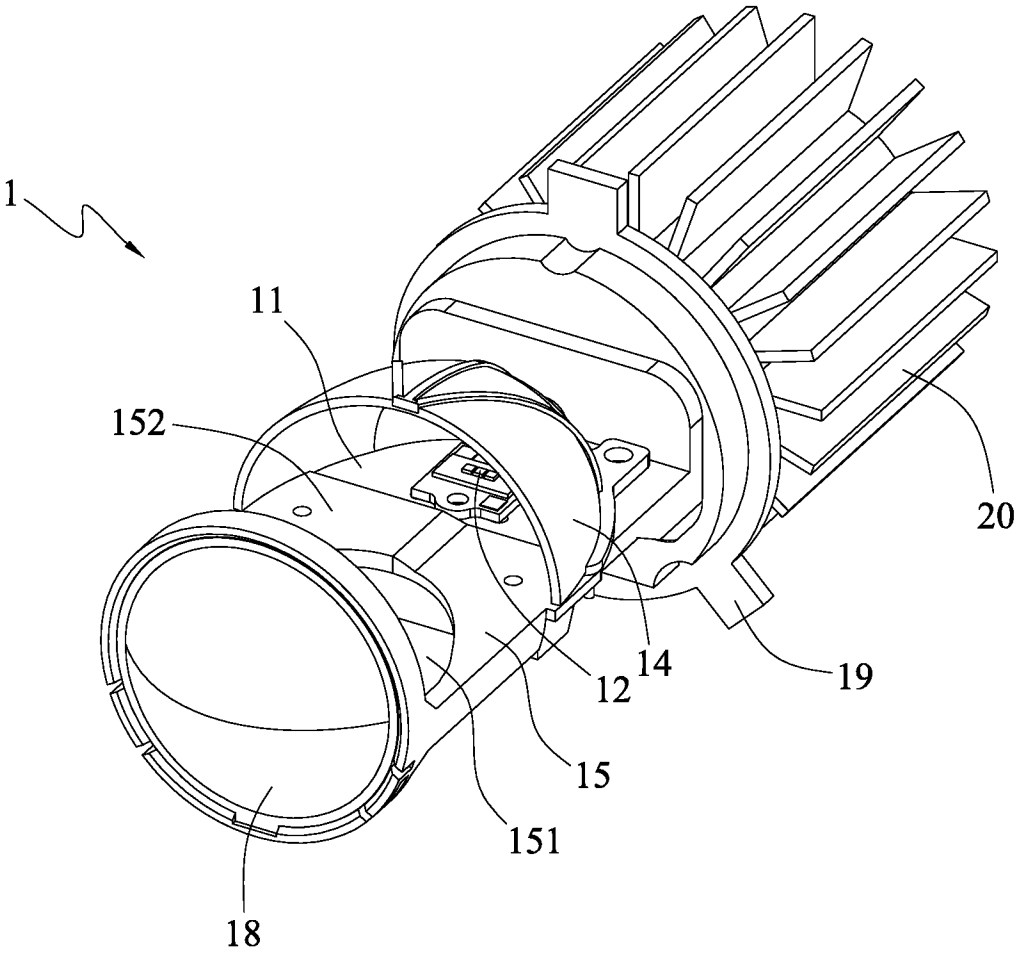
FIG. 1 is a schematic diagram of an illumination structure according to the present disclosure.
Figure 2:
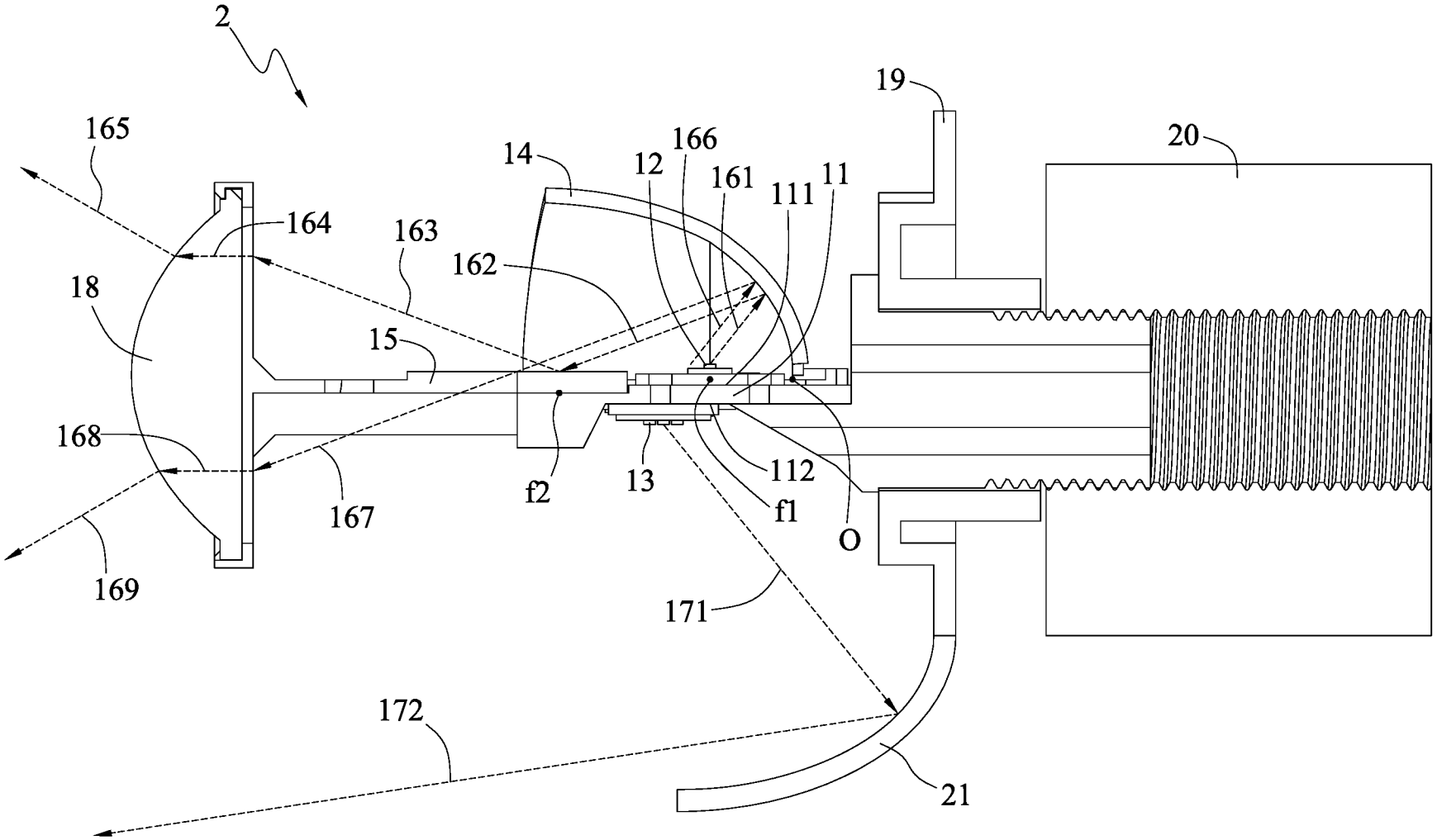
FIG. 2 is a cross-sectional diagram of an illumination structure disposed on a car lamp according to the FIG. 1.

Please refer to FIG. 1 and FIG. 2 simultaneously. FIG. 1 is a schematic diagram of an illumination structure according to the present disclosure. FIG. 2 is a cross-sectional diagram of an illumination structure disposed on a car lamp according to the FIG. 1. An illumination structure 1 is disposed in a reflective lamp cup 21 of a car lamp 2 according to the present disclosure. The illumination structure 1 has a substrate 11, a first light emitting element 12, a second light emitting element 13, a reflection housing 14 and a hooding board 15. The substrate 11 has a first face 111 and a second face 112 opposing the first face 111. The first light emitting element 12 is disposed on the first face 111, and the second light emitting element 13 is disposed on the second face 112. According to an embodiment, the first light emitting element 12 and the second light emitting element 13 consist of at least one light emitted diode. In an embodiment, the first light emitting element 12 consists of three light emitting diodes arranged horizontally. The present disclosure does not limit the quantity and arrangement of light emitting diodes. According to an embodiment, the light emitting diode is a surface light source. However, the present disclosure is not limited thereto.

The reflection housing 14 is disposed on the first face 111 of the substrate 11. In an embodiment, the reflection housing 14 is in the shape of a half elliptic cup. Therefore, when the reflection housing 14 is disposed on the first face 111, the reflection housing 14 can cover the first light emitting element, such that the first light emitting element is received in the reflection housing 14. The reflection housing 14 has a first focal point f1 and a second focal point f2 due to the fact that the reflection housing 14 is in the shape of a half elliptic cup. In an embodiment, the preferred width of the reflection housing 14 having the shape of a half elliptic cup and disposed on the first face 111 with an opening width between 15 mm to 38 mm is 37.2 mm. However, the present disclosure is not limited thereto.

The hooding board 15 has a hollow portion 151 and is connected to the substrate 11, with the hollow portion 151 away from the substrate 11. The hooding board 15 is not connected to the substrate through the hollow portion 151. In an embodiment, the hooding board 15 is made of copper or aluminum, and can dissipate heat.

In an embodiment, the first light emitting element 12 is disposed at the first focal point f1 of the reflection housing 14, and the second focal point f2 of the reflection housing 14 is positioned within the hooding board 15. Please refer to FIG. 2, when the first light emitting element 12 emits light, a second portion of the light will pass through the path 161, be reflected by the reflection housing 14, and project toward the second focal point f2 of the hooding board 15 via the path 162. Since the surface of the hooding board 15 is a reflective surface, the light can be reflected and passing along the path 163. The reflective surface is designed to improve optical efficiency.

In an embodiment, when the first light emitting element 12 emits light, a first portion of the light will pass along the path 166, be reflected by the reflection housing 14, and passes through the hollow portion 151 of the hooding board 15 via the path 167. In other words, the second portion of light emitted by the first light emitting element 12 will be reflected by the hooding board 15 within which the second focal point f2 is located, and the first portion of light after reflected by the reflection housing 14 will pass through the hollow portion 151 of the hooding board 15.

In an embodiment, a distance between a vertex O of the reflection housing 14 and the first focal point f1 is between 2 mm and 15 mm, and the preferred distance is 7.5 mm. However, the present disclosure is not limited thereto.

In an embodiment, the illumination structure 1 according to the present disclosure further comprises a lens 18 disposed at an end of the hooding board 15 away from the substrate 11. In another embodiment, the lens 18 is connected to the hollow portion 151 of the hooding board 15. When the first light emitting element 12 emits light, the second portion of the light passes through the lens 18 via the path 163 and the path 167. In an embodiment, the lens 18 is a convex lens, a plane-convex lens or a Fresnel lens. Therefore, the light passing through the lens 18 via the path 164 and the path 168 has the effect of focus. The light emitted from the path 169 forms a low beam light of the car lamp 2, and the light emitted from the path 165 will improve the overall optical efficiency for the illumination structure according to the present disclosure.

In an embodiment, the optimal diameter of the lens 18 ranges between 10 mm and 38 mm is 32 mm. However, the present disclosure is not limited thereto. In another embodiment, the second focal point f2 of the reflection housing 14 is positioned within the focal length of the lens 18. The preferred focal length of the lens 18 having a focal length between 10 mm and 35 mm is 25 mm. However, the present disclosure is not limited thereto.

In an embodiment, the hooding board 15 is formed with a block portion 152. In another embodiment, the block portion 152 is thicker than the rest of the hooding boarding 15. The block portion 152 is usually formed on the right side of the first path 162 where the light is emitted by the first light emitting element 12 and reflected by the reflection housing 14, for blocking a certain portion of the light and thereby forming an unsymmetrical low beam light for left-handed drivers. However, the present disclosure is not limited thereto. By controlling the position and thickness of the block portion 152, a person having ordinary skill in the art can generate an unsymmetrical low beam light that complies with laws and regulations for the left or right-handed drivers.

The second light emitting element 13 is disposed on the second face 112 of the substrate 11. Please refer to FIG. 2, the light emitted via the path 171 by the second light emitting element 13 and reflected by the reflective lamp cup 21 of the car lamp 2 shoots out via the path 172 to generate a high beam light directly. That is, the light emitted by the second light emitting element 13 and reflected by the reflective lamp cup 21 does not pass through the hooding board 15 and lens 18 and forms the light pattern of a high beam light. The second light emitting element 13 is disposed on the second face 112 of the substrate 11. By the degree of curvature of the reflective lamp cup 21 of the car lamp 2 (or the position of the highest luminous efficiency of the second light emitting element 13), a person having ordinary skill in the art can decide and make the light not passing through the hooding board 15 and lens 18, where the light is emitted by the second light emitting element 13 and reflected by the reflective lamp cup 21. The position of the second light emitting element 13 on the second face 112 of the substrate 11 generally corresponds to that used by a traditional halogen bulb of a car lamp. However, the present disclosure is not limited thereto.

The illumination structure according to the present disclosure can further comprise a fixing member 19 and a heat dissipating member 20. The fixing member 19 is connected on a side of the substrate 11 and having the shape of a discoid. The fixing member 19 has several convex parts for providing rotated engagement on the fixing socket of the car lamp 1. The heat dissipating member 20 is coupled to the fixing member 19 for providing the function of heat dissipating.

Figure 3:
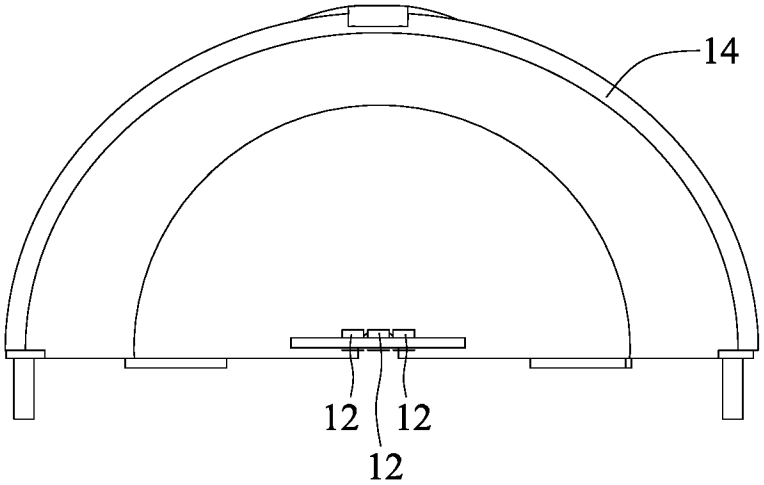
FIG. 3 is a schematic diagram of a reflection housing of an illumination structure of a first embodiment according to the present disclosure.
Figure 4A:
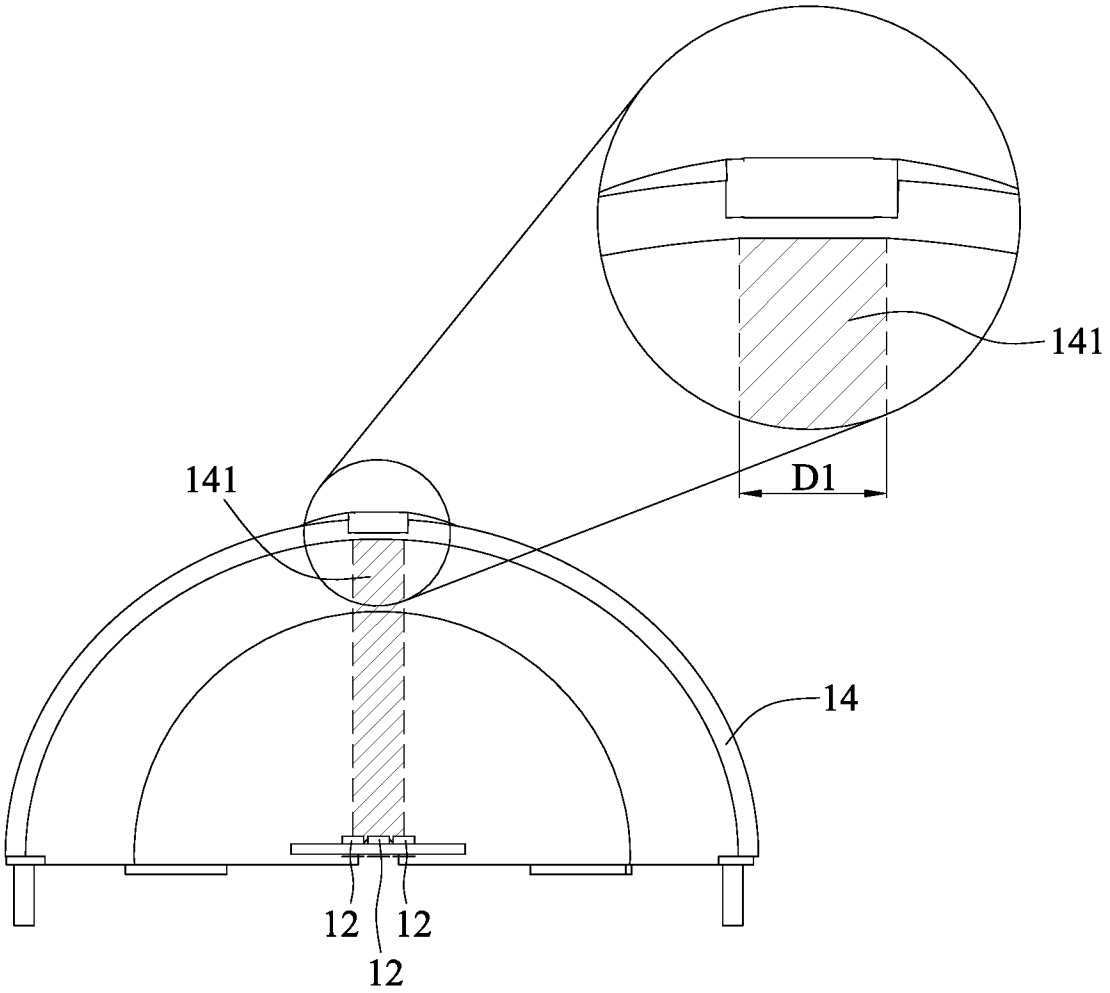
FIG. 4A is a schematic diagram of a reflection housing of an illumination structure of a second embodiment according to the present disclosure.
Figure 4B:
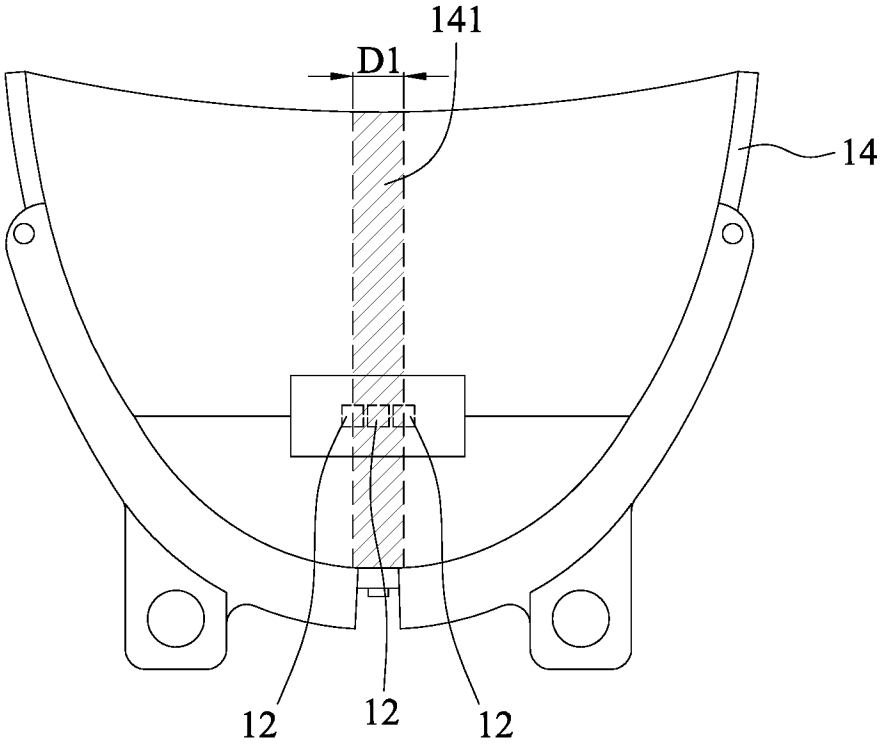
FIG. 4B is the top view of an illumination structure of the FIG. 4A.

Please refer to FIG. 3 and FIG. 4A, the reflection housing 14 of FIG. 3 does not have the planar portion 141 as shown in FIG. 4. The planar portion 141 is a flat striped surface with zero degree of curvature formed on the top of the first light emitting element 12. In an embodiment, as shown in FIG. 4B, the planar portion 141 is formed on a portion of the first light emitting element 12.

Accordingly, the reflection housing 14 having a planar portion 141 has two optical axes, that is, the light emitted by the first light emitting element 12 and then reflected by the planar portion 141 has one optical axis, and the light emitted by the first light emitting element 12 and then reflected by other area outside the planar portion 141 has another optical axis. However, the present disclosure does not limit the reflection housing 14 to have a planar portion 141. Nevertheless, the reflection efficiency is higher for a reflection housing having a straight plane portion 141 than the one without.

In an embodiment, the preferred width for width D1 of the straight plane portion 141 having a width between 0.01 mm to 4.6 mm is 0.04 mm. However, the present disclosure is not limited thereto.

Figure 5:
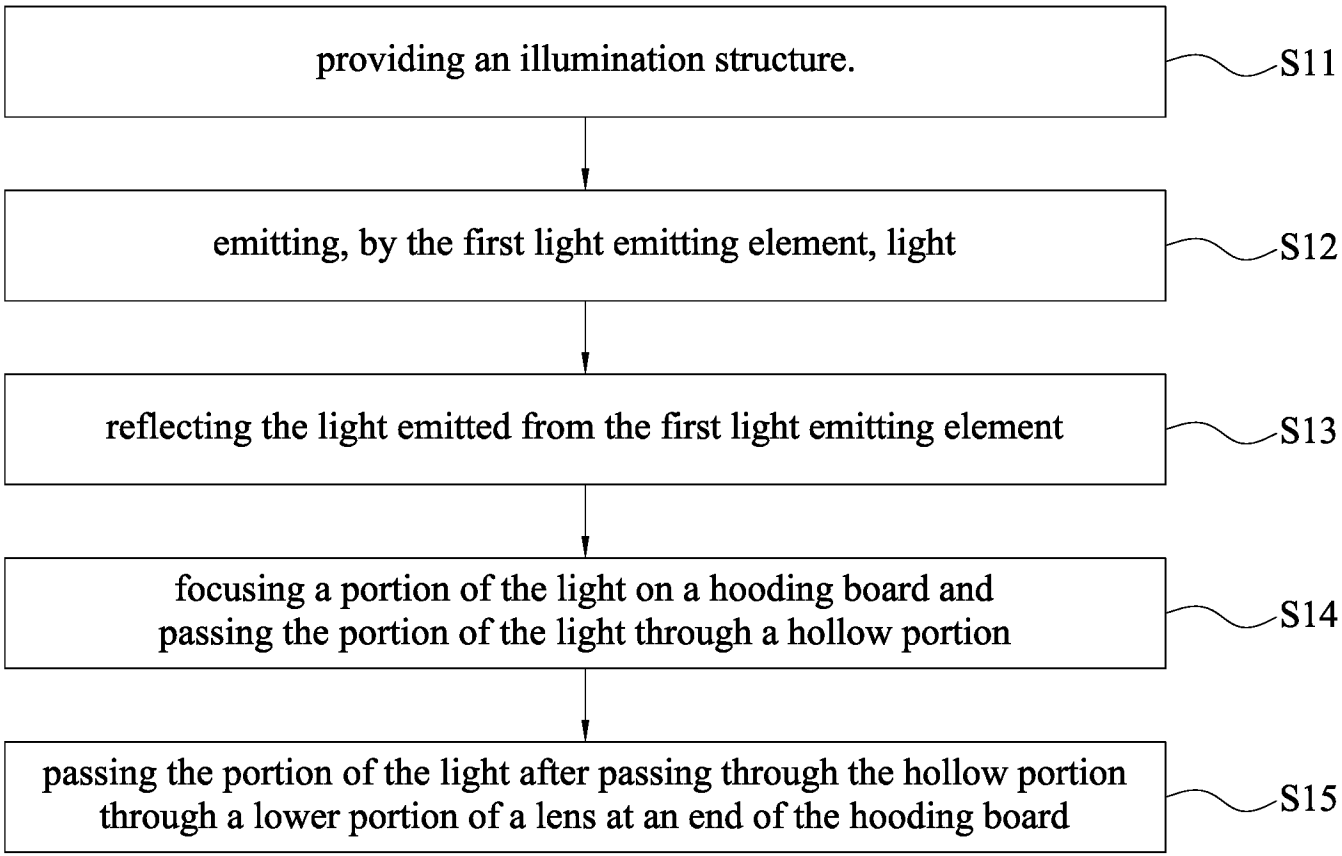
FIG. 5 is a flow chart of a light distributing method for an illumination structure according to the present disclosure.

Please refer to FIG. 5, where the present disclosure provides another light distributing method for an illumination structure that is applicable to a car lamp having a reflective lamp cup. The hardware components for the light distributing method for the illumination structure according to the present disclosure is the same as the previous illumination structure 1 according to the present disclosure. Therefore, the same technical content will not be repeated.

An illumination structure is provided in step S11. The illumination structure comprises a substrate, a first light emitting element, a second light emitting element, a reflection housing and a hooding board, wherein the substrate has opposing first and second faces, the first light emitting element is disposed on the first face, the second light emitting element is disposed on the second face, the reflection housing is disposed on the first face, for the first light emitting element to be disposed in the reflection housing, the hooding board has a hollow portion and connected to the substrate, with the hollow portion away from the substrate, the reflection housing has a first focal point and a second focal point, the first light emitting element is located at the first focal point, and the hollow portion is located at the second focal point.

In step S12, the first light emitting element emits light. The light emitted by the first light emitting element is then reflected by the reflection housing in step S13.

In step S14, a second portion of the light, after emitted by the first light emitting element and reflected by the reflection housing, is focused on the hooding board and a first portion of light emitted by the first light emitting element and reflected by the reflection housing passes through the hollow portion.

In step S15, the first portion of the light, after emitted by the first light emitting element and reflected by the reflection housing and passing through the hollow portion, passes through the lower part of the lens disposed at an end of the hooding board away from the substrate.

In an embodiment, a certain portion of the light, emitted by the first light emitting element and reflected by the reflection housing, is blocked by a block portion formed in the hooding board, such that the light pattern of a low beam light generated by the car lamp can be controlled as desired.

Figure 6:
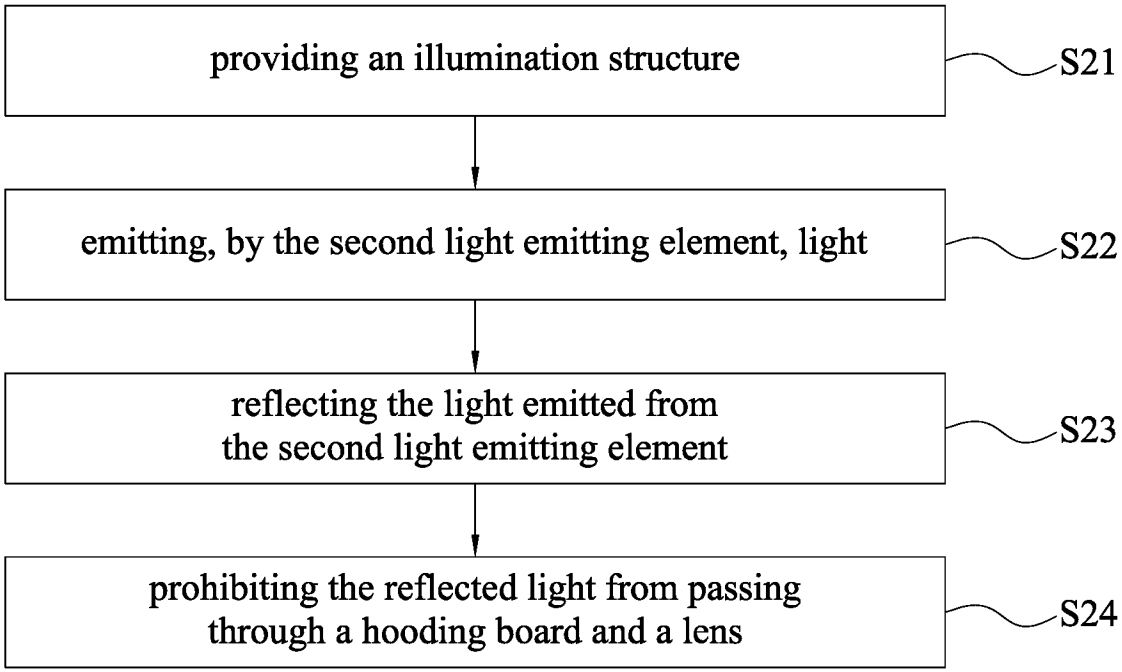
FIG. 6 is another flow chart of a light distributing method for an illumination structure according to the present disclosure.

Please refer to FIG. 6, the present disclosure further provides a light distributing method for an illumination structure that is applicable to a car lamp having a reflective lamp cup. The hardware components for the light distributing method for the illumination structure according to the present disclosure is the same as the illumination structure 1 according to the previous present disclosure. Therefore, the same technical content will not be repeated.

An illumination structure is provided in step S21. In step S22, the second light emitting element emits light. In step S23 and S24, the light emitted by the second light emitting element and reflected by the reflective lamp cup does not pass through the hooding board and the lens, and directly generates the light pattern of a high beam light of the car lamp.

According to a light distributing method for an illumination structure of the present disclosure, the light can be emitted from the first light emitting element and the second light emitting element separately, thus producing light patterns of a low beam light and a high beam light of the car lamp separately. The light can be emitted from the first light emitting element and the second light emitting element simultaneously. However, the present disclosure is not limited thereto.

According to the light distributing method for an illumination structure of the present disclosure, the illumination structure is equipped with a reflection housing which is different from the reflective lamp cup in a conventional car lamp, for the first light emitting element is disposed at the first focal point of the reflection housing, so that the light emitted by the first light emitting element and reflected by the reflection housing passes through the hollow portion of the hooding board disposed within which the second focal point of the reflection housing is located, in order to generate the light pattern of a low beam light that is in compliance with laws and regulations. In addition, the reflection housing, which receives the first light emitting element, is incorporated in the illumination structure of the present disclosure, and the second light emitting element is disposed on the second face of the substrate at a position equivalent to the traditional halogen bulb in a car lamp, whereby the light emitted by the second light emitting element can make use of the reflective lamp cup of the original car lamp to produce the light pattern of a high beam light. Therefore, for the convenience of users switching from a car lamp of a traditional halogen bulb to an LED light source, the present disclosure allows the direct installation of an illumination structure in a correspondent car lamp having the reflective lamp cup to reflect the light emitted by the traditional halogen bulb.

The foregoing descriptions of the detailed embodiments are only illustrated to disclose the features and functions of the present disclosure and not restrictive of the scope of the present disclosure. It should be understood to those in the art that all modifications and variations according to the spirit and principle in the disclosure of the present disclosure should fall within the scope of the appended claims.

What is claimed is:

1. A car lamp having a reflective lamp cup and an illumination structure, the illumination structure comprising:

a substrate having opposing first and second faces;

a reflection housing disposed on the first face and having a first focal point and a second focal point;

a first light emitting element disposed on the first face of the substrate and received in the reflection housing in a manner that the first light emitting element is located at the first focal point of the reflection housing;

a second light emitting element disposed on the second face of the substrate;

a hooding flat board having a hollow portion and a block portion, the hooding flat board coupled to the substrate in a manner that the hollow portion of the hooding flat board is positioned away from the substrate and the second focal point is positioned within the hooding flat board, and a lens coupled to an end of the hooding flat board away from the substrate, wherein the illumination structure is disposed in the reflective lamp cup of the car lamp, wherein, after light emitted by the first light emitting element is reflected by the reflection housing, a first portion of the light reflected by the reflection housing passes through the hollow portion of the hooding flat board and passes through the lens, wherein the block portion is thicker than a rest of the hooding flat board and formed in a path where the light emitted by the first light emitting element is reflected by the reflection housing to block a certain portion of the light and thereby forming an unsymmetrical low beam, wherein light emitted by the second light emitting element and reflected by the reflective lamp cup is free from passing through the hooding flat board and the lens and forms high beam light of the car lamp, and wherein the reflection housing has a planar portion corresponding in position to the first light emitting element, and the planar portion has a width between 0.01 mm to 4.6 mm.

2. The car lamp of claim 1, wherein the lens is a convex lens, a plane-convex lens or a Fresnel lens.

3. The car lamp of claim 1, wherein at least one of the first light emitting element and the second light emitting element is composed of at least one light emitting diode.

4. The car lamp of claim 3, wherein the light emitting diode is a surface light source.

5. The car lamp of claim 1, wherein the reflection housing is in a shape of a half elliptic cup.

6. A light distributing method applicable to a car lamp having a reflective lamp cup and an illumination structure disposed in the reflective lamp cup of the car lamp, the light distributing method comprising:

providing the illumination structure including a substrate having opposing first and second faces, a reflection housing disposed on the first face of the substrate and having a first focal point and a second focal point, a first light emitting element disposed on the first face of the substrate and received in the reflection housing at a position where the first focal point is located, a second light emitting element disposed on the second face of the substrate, and a hooding flat board having a hollow portion and a block portion, the hooding flat board coupled to the substrate in a manner that the hollow portion is away from the substrate and the second focal point of the reflection housing is positioned within the hooding flat board, wherein the reflection housing has a planar portion corresponding in position to the first light emitting element, and the planar portion has a width between 0.01 mm to 4.6 mm;

emitting light by the first light emitting element for the light to be reflected by the reflection housing; and focusing a second portion of the light emitted by the first light emitting element and reflected by the reflection housing on the hooding flat board, and allowing a first portion of the light emitted by the first light emitting element and reflected by the reflection housing to pass through the hollow portion and further pass through a lens coupled to an end of the hooding flat board away from the substrate, wherein the block portion is thicker than a rest of the hooding flat board and formed in a path where the light emitted by the first light emitting element is reflected by the reflection housing to block a certain portion of the light and thereby forming an unsymmetrical low beam;

wherein light emitted by the second light emitting element and reflected by the reflective lamp cup is free from passing through the hooding flat board and the lens and forms high beam light of the car lamp.

7. The light distributing method of claim 6, wherein the lens is a convex lens, a plane-convex lens or a Fresnel lens.

8. The light distributing method of claim 6, wherein the reflection housing is in a shape of a half elliptic cup.

9. The light distributing method of claim 6, wherein at least one of the first light emitting element and the second light emitting element is composed of at least one light emitting diode.

10. The light distributing method of claim 9, wherein the light emitting diode is a surface light source.

* * * * *